US005157365A

United States Patent [19]

Hoang

[11] Patent Number: 5,157,365

[45] Date of Patent: Oct. 20, 1992

[54] COMBINED BLOCK-SUBSTRATE FILTER

[75] Inventor: Truc G. N. Hoang, Albuquerque, N. Mex.

[73] Assignee: Motorola, Inc., Schaumburg, Ill.

[21] Appl. No.: 654,719

[22] Filed: Feb. 13, 1991

[51] Int. Cl.[5] ..... H01P 1/202

[52] U.S. Cl. ..... 333/206; 333/207

[58] Field of Search ..... 333/202, 204, 206, 207, 333/222, 134

[56] References Cited

U.S. PATENT DOCUMENTS

| | | | |
|---|---|---|---|
| Re. 32,768 | 10/1988 | D'Avello et al. | 333/202 |
| 4,431,977 | 2/1984 | Sokola et al. | 333/206 |
| 4,757,288 | 7/1988 | West | 333/202 X |
| 4,879,533 | 11/1989 | deMuro et al. | 333/206 |
| 4,987,393 | 1/1991 | Yorita et al. | 333/202 |

FOREIGN PATENT DOCUMENTS

| | | | |
|---|---|---|---|
| 0015401 | 1/1986 | Japan | 333/206 |

*Primary Examiner*—Eugene R. LaRoche
*Assistant Examiner*—Seung Ham
*Attorney, Agent, or Firm*—Darleen J. Stockley

[57] ABSTRACT

A block-substrate dielectric filter with an a wider VHF range and better capacitive performance is set forth. A capacitive matrix situated in a dielectric substrate (102) that is operably attached to a block (104) filter provides more accurate shunt and series capacitances, and allows design of improved narrowband filters.

15 Claims, 2 Drawing Sheets

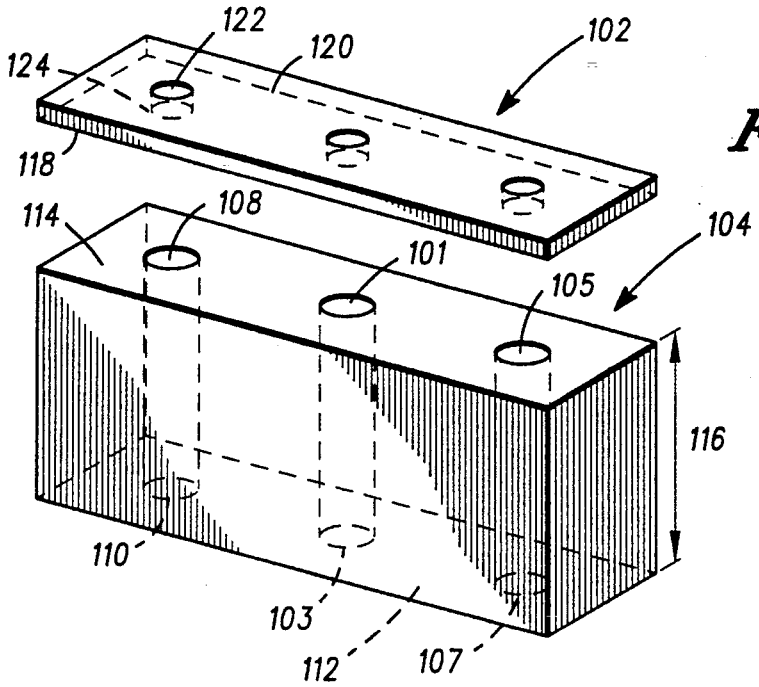
FIG. 1
FIG. 2A
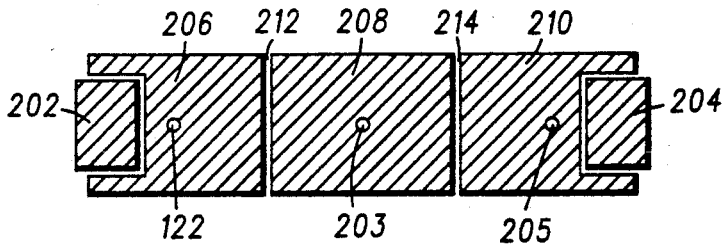
FIG. 2B
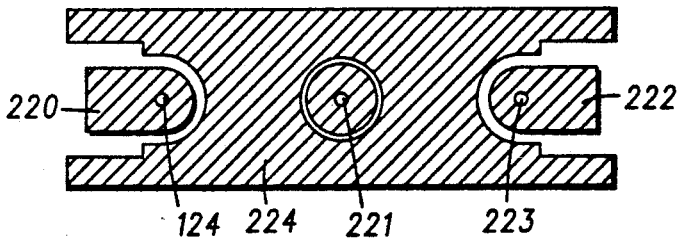
FIG. 2C
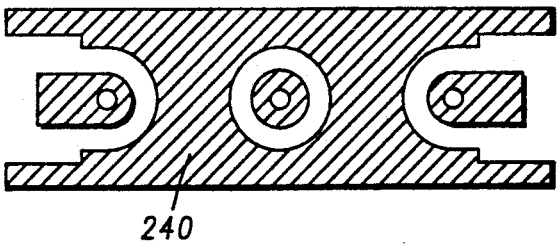

COMBINED BLOCK-SUBSTRATE FILTER

FIELD OF THE INVENTION

The present invention is generally related to radio-frequency (RF) signal filters, and more particularly to ceramic block filters.

BACKGROUND OF THE INVENTION

Radio-frequency block filters, typically ceramic, have long been utilized in radio receivers, transmitters and the like. Frequently, insufficient shunt capacitance to ground has been obtained, and too much coupling between resonators typically has resulted in filters having wider frequency bands than desired. There is a need for a filter that provides a narrow frequency band and greater shunt capacitance to ground.

SUMMARY OF THE INVENTION

A combined block-substrate dielectric filter is provided, comprising at least: a first volume of dielectric material substantially arranged to provide at least a first conductive resonator unit extending from a first surface of said first volume of dielectric material to a second surface of said first volume of dielectric material, said at least first conductive resonator unit substantially being formed in the first volume of dielectric material utilizing at least two primary apertures, substantially coaxial, extending from the first surface of said first volume of dielectric material to the second surface of said first volume of dielectric material, and having a conductive layer formed on an inner peripheral surface of at least the two extended primary apertures, said second surface of the first volume of dielectric material having at least a first conductive connection thereon, and at least part of said first volume of dielectric material being substantially covered with a conductive material; a second volume of dielectric material having at least a second set of two secondary apertures substantially coaxial and substantially aligned with the two extended primary apertures in the first volume of dielectric material and extending from a first surface of said second volume of dielectric material to a second surface of said second volume of dielectric material, at least part of the said second volume of dielectric material being substantially covered with a conductive surface, at least selected portions of the said first surface of the second volume of dielectric material being substantially bonded to at least selected portions of the said second surface of the first volume of dielectric material, having at least a first filter unit therein/thereon, and having at least a second conductive connection therein/thereon operably coupled to at least the first filter unit, for connecting with at least the first conductive connection of the first volume of dielectric material, further having at least third and fourth conductive connections disposed on at least said second surface of the second volume of dielectric material that are operably connectable to input/output conductive connections of a substrate base and are operably connected to at least selected filter unit of the second volume of dielectric material; if desired, further conductive connections disposed on/in said second surface of said first volume of dielectric material and on/in said first surface of said second volume of dielectric material, for substantially operably connecting at least further selected filter units of said second volume of dielectric material to selected resonator unit portions of said first volume of dielectric material; such that desired conductive resonators are adjusted substantially by utilizing at least the first selected filter unit of said second volume of dielectric material.

BRIEF DESCRIPTION OF THE DRAWINGS

FIG. 1 is a schematic of a perspective side view of a typical bare substrate and a typical bare block to be modified in accordance with the present invention.

FIG. 2A–2C are schematic diagrams of a first embodiment of a first combination of surface networks utilized in/on a combined block-substrate dielectric filter substantially in accordance with the present invention.

DETAILED DESCRIPTION OF A PREFERRED EMBODIMENT

Figure 3A:
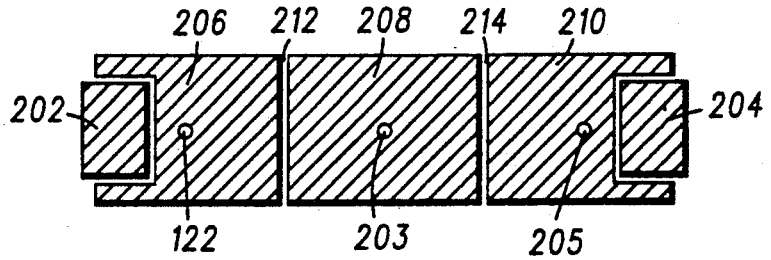
FIG. 3A–3C are schematic diagrams of a second embodiment of a second combination of surface networks utilized in/on a combined block-substrate dielectric filter substantially in accordance with the present invention.

FIG. 1 is a schematic of a perspective side view of a typical bare substrate (102) and a typical bare block (104) to be modified in accordance with the present invention. A first volume of dielectric material, typically a block, is substantially arranged to provide at least a first resonator unit. At least the first resonator unit, typically utilizable as an independent filter unit, generally comprises at least two primary apertures (108, 110, . . . ), substantially arranged in coaxial pairs of apertures (if desired: 101, 103; 105, 107; . . . ) that are substantially connected by extension of the apertures from a first surface (112) of said first volume of dielectric material to a second surface (114) of said first volume of dielectric material, and is modified to provide a conductive layer formed on an inner peripheral surface of the connected pairs of primary apertures. A height (LEN)(116) of at least the first resonator is substantially determined along a line substantially parallel to the axis of the primary apertures.

FIG. 2A–2C are schematic diagrams of a first embodiment of a first combination of surface networks utilized in/on a combined block-substrate dielectric filter substantially in accordance with the present invention. FIG. 2A substantially illustrates a first embodiment of an example of a three pole combline filter having a first network pattern for a second surface (120) of a second volume (102) of dielectric material in accordance with the present invention; FIG. 2B substantially illustrates the first embodiment of the example of the three pole combline filter having a second network pattern for a first surface (118) of a second volume (102) of dielectric material in accordance with the present invention; and FIG. 2C substantially illustrates the first embodiment of the example of the three pole combline filter having a third network pattern for a second surface (114) of a first volume (104) of dielectric material in accordance with the present invention.

The combined block-substrate dielectric filter of the present invention comprises at least a first volume (104) of dielectric material, substantially as set forth in the three pole combline filter example, substantially arranged to provide at least a first conductive resonator unit extending from a first surface (112) of said first volume (104) of dielectric material to a second surface (114) of said first volume (104) of dielectric material, said at least first conductive resonator unit substantially being formed in the first volume (104) of dielectric material utilizing at least two primary apertures (108, 110, . . . ), substantially coaxial, extending from the first surface (112) of said first volume (104) of dielectric material to the second surface (114) of said first volume (104) of dielectric material, and having a conductive layer formed on an inner peripheral surface of at least the two extended primary apertures (108, 110, . . . ), said second surface (114) of the first volume (104) of dielectric material having at least a first conductive connection thereon (240), and at least part of said first volume (104) of dielectric material being substantially covered with a conductive material.

A second volume (102) of dielectric material typically has, substantially as set forth in the three pole combline filter example, at least a second set (122, 124) of two secondary apertures (if desired: 203, 221; 205, 223; . . . ) substantially coaxial and each second set being substantially aligned with a respective first set of two extended primary apertures (108, 110) in a first volume (104) of dielectric material (104) and extending from a first surface (118) of said second volume (102) of dielectric material to a second surface (120) of said second volume (102) of dielectric material, at least part of the said second volume (102) of dielectric material being substantially covered with a conductive surface, at least selected portions (224) of the said first surface (118) of the second volume (102) of dielectric material being substantially bonded to at least selected portions (240) of the said second surface (114) of the first volume (104) of dielectric material, having at least a first selected filter unit therein/thereon (220, 222, . . . ) and having at least a second conductive connection therein/thereon (220, 222, . . . ) operably coupled to at least the first selected filter unit (220, 222, . . . ), for connecting with at least the first conductive connection (240) of the first volume (104) of dielectric material, further having at least third and fourth conductive connections (202, 204, . . . ) disposed on at least said second surface (120) of the second volume (102) of dielectric material that are operably connectable to input/output conductive connections of a substrate base and are operably connected to at least a second selected filter unit (202, 206, 208, 210, 204, 212, 214, . . . ) of the second volume (102) of dielectric material. At least the first selected filter unit (220, 222, . . . ) and at least the second filter unit (202, 206, 208, 210, 204, 212, 214, . . . ) of the second volume (102) of dielectric material each typically comprise at least a first capacitor. At least the first selected filter unit may be selected to comprise at least first and second electrodes, comprising at least a first capacitor, for conductively connecting to a selected conductive connection of at least a first selected resonator unit of the first volume (104) of dielectric material, and being disposed on/in a selected surface of said second volume (102) of dielectric material.

At least the first conductive resonator unit may be selected to further comprise a conductive material substantially covering the surfaces of the primary and secondary apertures extending from said first surfaces (112, 118) of said first and second volumes (104, 102) of dielectric material to said second surfaces (114, 120) of said first and second volumes (104, 102) of dielectric material.

Resonator units may further include, where desired, at least further desired selected filter units. At least the further desired selected filter units may be selected to comprise at least one of:

third and fourth electrodes, comprising at least a second capacitor for at least a first selected conductive resonator, disposed on/in a selected surface of said first volume of dielectric material;

a fifth electrode, disposed in/on a selected surface of said first volume of dielectric material for operably coupling at least one resonator unit to a further resonator unit; and at least a first inductive component.

Silver bonding is typically utilized for bonding of at least selected portions of the said first surface (118) of the said second volume (102) of dielectric material to at least selected portions of the said second surface (114) of the said first volume (104) of dielectric material.

Typically at least selected portions (224) of the said first surface (118) of the second volume (102) of dielectric material bonded to at least selected portions (240) of the said second surface (114) of the first volume (104) of dielectric material are also grounded.

Figure 3B:
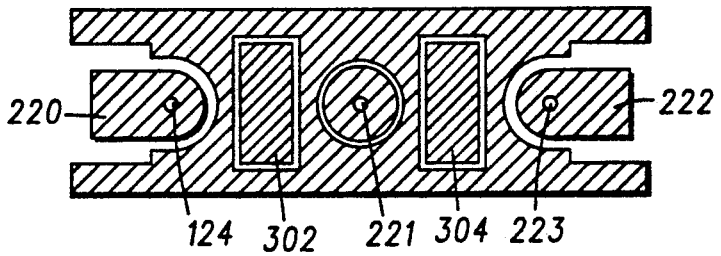
Figure 3C:
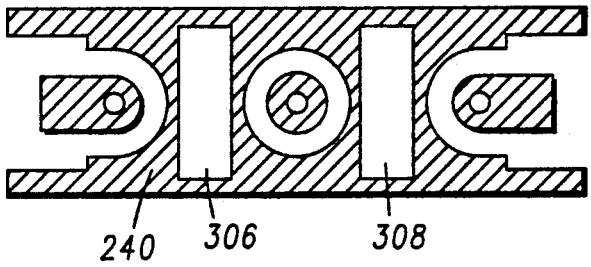

FIG. 3A-3C are schematic diagrams of a second embodiment of a second combination of surface networks utilized in/on a combined block-substrate dielectric filter substantially in accordance with the present invention, wherein a fourth network pattern of the first surface (118) of the second volume (102), while similar to the second network pattern of the first surface (118) of the second volume (102) of FIG. 2B, also includes at least two further selected capacitors (302, 304, . . . ), and wherein, a fifth network pattern of the second surface (114) of the first volume (104), while similar to the third network pattern of the second surface (114) of the first volume (104) of FIG. 2C, also includes at least two areas (306, 308, . . . ) that are substantially not bonded to the first surface (118) of the second volume (102). The second embodiment operates substantially in correspondence with the manner described hereinabove for the first embodiment, and additionally provides for utilization of strong series capacitances.

Generally, dielectric materials are selected for the substrate (102) and the block (104) that yield a filter with desired frequency characteristics. Silver bonding typically provides a suitable connection as desired between at least the first surface (118) of the second volume of dielectric material and at least the second surface (114) of the first volume of dielectric material. Typically, a ground connection is utilized along the first surface of the first volume, being that surface that is furthest from the second surface (114) of the first volume (104), being that first volume surface that is bonded to a surface of the substrate (102). Volumes of dielectric materials may be selected, if desired, as parallelepipeds.

If desired, further conductive connections are disposed in corresponding fashion on said second surface (114) of said first volume (104) of dielectric material and on said first surface (118) of said second volume (102) of dielectric material, for substantially operably connecting at least further selected filter units of said second volume (102) of dielectric material to selected resonator unit portions of said first volume (104) of dielectric material.

Figure 4:
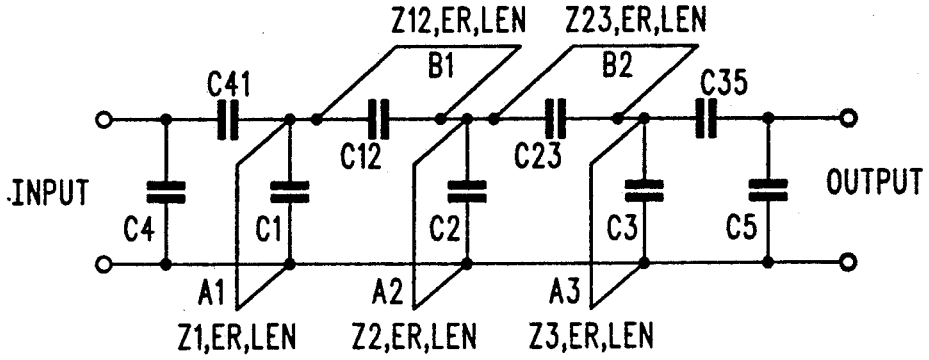
FIG. 4 is a schematic layout illustrating an equivalent circuit diagram of a three pole combine filter arranged in accordance with the present invention.

FIG. 4 is a schematic layout illustrating an equivalent circuit diagram of the example of the three pole combline filter arranged in accordance with the present invention. Typical capacitances (C4, C1, C2, C3, C5, C41, C12, C23, C35) are selectable, and may be illustrated by noting that, for example, in FIG. 2, selected capacitances may be selected to correspond to certain substrate patterns (C4,202, also functioning as an I/O pad; C1, 206; C2, 208; C34, 210; C5,204, also functioning as an I/O pad; C41,220; C12,212; C23,214; C35,222). Each resonator is shown as a length of transmission line (A1, A2, A3), further depicting transmission line impedances, permittivities, and resonator lengths associated therewith (Z1, ER, LEN; Z2, ER, LEN; Z3, ER, LEN). Further transmission lines (B1, B2) illustrate interactions (Z12, ER, LEN; Z23, ER, LEN) between adjacent resonator holes substantially having selected lengths LEN and selected permittivities, Er (ER). For example, a block (first volume) substantially with a permittivity of 78, having dimensions of $0.450 \times 1.500 \times 0.592$, with three holes of 0.103 diameter and 0.500 center to center spacing, could be utilized with a substrate (second volume) of 0.040 thickness and consisting substantially of two dielectric materials with permittivities substantially of 78 and 250, and may be combined, in one selected embodiment, with capacitances as set forth below (in picofarads):

| | | Block-Substrate Technique | |
|---|---|---|---|
| | Prior Technique (Max Realizable) | Er = 78, Substrate 1 (Max Realizable) | Er = 250, Substrate 2 (Max Realizable) |
| C1 | 10 | 39 | 125 |
| C2 | 15 | 63 | 210 |
| C3 | 10 | 39 | 125 |
| C12 | 4 | 28 | 90 |
| C23 | 4 | 28 | 90 |
| C41 | 3 | 20 | 65 |
| C35 | 3 | 20 | 65 |
| Lowest Operating $F_o$ | 400 | 200 | 100 MHz |

Where C12 and C23 are selected as relatively small, the filter is non-elliptical, and, where C12 and C23 are selected as relatively large, the filter is elliptical.

Clearly, the exemplary embodiments do not limit the present invention to the examples cited, but the examples are sent forth to show selected implementations of the present invention.

The present invention provides more flexibility in block filters, allowing better adjustment of block capacitance by utilizing the substrate, that makes possible capacitance values at least four times more than those possible utilizing a block only, and by providing greater inductive component range with the block. Filters may thus be constructed with a frequency range that extends as low as 100 MHz, in comparison to 400 MHZ of present technology.

I claim:

1. A combined block-substrate dielectric filter comprising at least:

A) a first volume of dielectric material substantially arranged to provide at least a first conductive resonator means extending from a first surface of said first volume of dielectric material to a second surface of said first volume of dielectric material, said at least first conductive resonator means substantially being formed in the first volume of dielectric material utilizing at least two primary apertures, substantially coaxial, extending from the first surface of said first volume of dielectric material to the second surface of said first volume of dielectric material, and having a conductive layer formed on an inner peripheral surface of at least the two extended primary apertures, said second surface of the first volume of dielectric material having at least a first conductive connection thereon, and at least part of said first volume of dielectric material being substantially covered with a conductive material; and B) a second volume of dielectric material having at least a second set of two secondary apertures substantially coaxial and each second set being substantially aligned with a respective first set of the two extended primary apertures in the first volume of dielectric material and extending from a first surface of said second volume of dielectric material to a second surface of said second volume of dielectric material, at least part of the said second volume of dielectric material being substantially covered with a conductive surface, at least selected portions of the said first surface of the second volume of dielectric material being substantially bonded to at least selected portions of the said second surface of the first volume of dielectric material, having at least a first selected filter means hereon, and having at least a second conductive connection hereon operably coupled to at least the first selected filter means, for connecting with at least the first conductive connection of the first volume of dielectric material, further having at least third and fourth conductive connections disposed on at least said second surface of the second volume of dielectric material that are operably connectable to input/output conductive connections of a substrate base and are operably connected to at least second selected filter means of the second volume of dielectric material;

such that further conductive connections may be disposed on said second surface of said first volume of dielectric material and on said first surface of said second volume of dielectric material, for substantially operably connecting at least further selected filter means of said second volume of dielectric material to selected resonator means portions of said first volume of dielectric material; and such that desired conductive resonators are adjusted substantially by utilizing at least first selected filter means of said second volume of dielectric material.

2. The combined block-substrate dielectric filter of claim 1, wherein at least the first conductive resonator means further comprises a conductive material substantially covering the surfaces of the primary and secondary apertures extending from said first surface of said first and second volumes of dielectric material to said second surface of said first and second volumes of dielectric material.

3. The combined block-substrate dielectric filter of claim 1, wherein at least the first selected filter means comprises at least first and second electrodes, comprising at least a first capacitor, for conductively connecting to a selected conductive connection of at least a first selected resonator means of the first volume of dielectric material, and being disposed on a selected surface of said second volume of dielectric material.

4. The combined block-substrate dielectric filter of claim 1, wherein said selected resonator means further include at least further desired selected filter means.

5. The combined block-substrate dielectric filter of claim 1, wherein bonding of at least selected portions of the said first surface of the said second volume of dielectric material to at least selected portions of the said second surface of the said first volume of dielectric material is silver bonding.

6. A combined block-substrate dielectric filter comprising at least:

A) a first parallelepiped of dielectric material substantially arranged to provide at least a first conductive resonator means extending from a first surface of said first parallelepiped of dielectric material to a second surface of said first parallelepiped of dielectric material, said at least first conductive resonator means substantially being formed in the first parallelepiped of dielectric material utilizing at least two primary apertures, substantially coaxial, extending from a first surface of said first volume of dielectric material to a second surface of said first volume of dielectric material and having a conductive layer formed on an inner peripheral surface of the primary apertures, said second surface of the first parallelepiped of dielectric material having at least a first conductive connection thereon, and at least part of said first parallelepiped of dielectric material being substantially covered with a conductive material; and B) a second parallelepiped of dielectric material having at least two secondary apertures substantially coaxial and each second set being substantially aligned with a respective first set of two primary apertures in the first parallelepiped of dielectric material and extending from a first surface of said second parallelepiped of dielectric material to a second surface of said second parallelepiped of dielectric material, at least part of the said second parallelepiped of dielectric material being substantially covered with a conductive surface, at least selected portions of the said first surface of the second parallelepiped of dielectric material being substantially bonded to at least selected portions of the said second surface of the first parallelepiped of dielectric material, having at least a first filter means thereon, and having at least a second conductive connection thereon coupled to at least the first filter means, for connecting with at least the first conductive connection of the first parallelepiped of dielectric material, further having at least third and fourth conductive connections disposed on said second surface and at least a part of a third surface of the second parallelepiped of dielectric material that are operably connected to input/output conductive connections of a substrate and are operably connected to at least selected filter means of the second volume of dielectric material;

such that further conductive connections may be disposed in corresponding fashion on said second surface of said first parallelepiped of dielectric material and on said first surface of said second parallelepiped of dielectric material, for substantially operably connecting at least further selected filter means of said second parallelepiped of dielectric material to selected resonator means of said first parallelepiped of dielectric material; and such that desired conductive resonators are adjusted substantially by utilizing at least first selected filter means of said second parallelepiped of dielectric material.

7. The combined block-substrate dielectric filter of claim 6, at least the first conductive resonator means further comprises a conductive material substantially covering the surfaces of the primary and secondary apertures extending from said first surface of said first and second parallelepipeds of dielectric material to said second surface of said first and second parallelepipeds of dielectric material.

8. The combined block-substrate dielectric filter of claim 6, wherein at least the first selected filter means comprises at least first and second electrodes, comprising at least a first capacitor, for conductively connecting to a selected conductive connection of at least a first selected resonator means of the first parallelepiped of dielectric material, and being disposed on a selected surface of said second parallelepiped of dielectric material.

9. The combined block-substrate dielectric filter of claim 6, wherein said selected resonant means further include at least further desired selected filter means.

10. The combined block-substrate dielectric filter of claim 6, wherein bonding of at least selected portions of the said first surface of the said second parallelepiped of dielectric material to at least selected portions of the said second surface of the said first parallelepiped of dielectric material is silver bonding.

11. A radio having at least a first combined block-substrate dielectric filter comprising at least:

A) a first volume of dielectric material substantially arranged to provide at least a first conductive resonator means extending from a first surface of said first volume of dielectric material to a second surface of said first volume of dielectric material, said at least first conductive resonator means substantially being formed in the first volume of dielectric material utilizing at least two primary apertures, substantially coaxial, extending from the first surface of said first volume of dielectric material to the second surface of said first volume of dielectric material, and having a conductive layer formed on an inner peripheral surface of at least the two extended primary apertures, said second surface of the first volume of dielectric material having at least a first conductive connection thereon, and at least part of said first volume of dielectric material being substantially covered with a conductive material; and B) a second volume of dielectric material having at least a second set of two secondary apertures substantially coaxial and each second set being substantially aligned with a respective first set of two extended primary apertures in the first volume of dielectric material and extending from a first surface of said second volume of dielectric material to a second surface of said second volume of dielectric material, at least part of the said second volume of dielectric material being substantially covered with a conductive surface, at least selected portions of the said first surface of the second volume of dielectric material being substantially bonded to at least selected portions of the said second surface of the first volume of dielectric material, having at least a first selected filter means thereon, and having at least a second conductive connection thereon operably coupled to at least the first selected filter means, for connecting with at least the first conductive connection of the first volume of dielectric material, further having at least third and fourth conductive connections disposed on at least said second surface of the second volume of dielectric material that are operably connectable to input/output conductive connections of a substrate base and are operably connected to at least second selected filter means of the second volume of dielectric material;

such that further conductive connections may be disposed on said second surface of said first volume of dielectric material and on said first surface of said second volume of dielectric material, for substantially operably connecting at least further selected filter means of said second volume of dielectric material to selected resonator means portions of said first volume of dielectric material; and such that desired conductive resonators are adjusted substantially by utilizing at least first selected filter means of said second volume of dielectric material.

12. The radio transceiver of claim 11, wherein at least the first conductive resonator means of at least the first said filter further comprises a conductive material substantially covering the surfaces of the primary and secondary apertures extending from said first surface of said first and second volumes of dielectric material to said second surface of said first and second volumes of dielectric material.

13. The radio of claim 11, wherein the at least first filter means of at least the first said filter comprises at least first and second electrodes, comprising at least a first capacitor, for conductively connecting to a selected conductive connection of at least a first selected resonator means of the first volume of dielectric material, and being disposed on a selected surface of said second volume of dielectric material.

14. The radio transceiver of claim 11, wherein resonator means of at least the first said filter further include at least further desired selected filter means.

15. The radio of claim 11, wherein bonding of at least selected portions of the said first surface of the said second volume of dielectric material to at least selected portions of the said second surface of the said first volume of dielectric material is silver bonding.

* * * * *